US006286522B1

(12) United States Patent
Høst-Madsen et al.

(10) Patent No.: US 6,286,522 B1
(45) Date of Patent: Sep. 11, 2001

(54) METHOD OF WASHING DISHES AND PREPARING EQUIPMENT FOR USE IN THE ARRANGEMENT AND SERVING OF FLIGHT MEALS

(75) Inventors: Knud Høst-Madsen, Hellerup; Steen Reenberg, Hillerød, both of (DK)

(73) Assignee: Gate Gourmet International AG, Zurich (CH)

( * ) Notice: Subject to any disclaimer, the term of this patent is extended or adjusted under 35 U.S.C. 154(b) by 0 days.

(21) Appl. No.: 09/230,280

(22) PCT Filed: Jul. 25, 1997

(86) PCT No.: PCT/DK97/00321

§ 371 Date: May 13, 1999

§ 102(e) Date: May 13, 1999

(87) PCT Pub. No.: WO98/04180

PCT Pub. Date: Feb. 5, 1998

(30) Foreign Application Priority Data

Jul. 26, 1996 (DK) ..... 0816/96

(51) Int. Cl.[7] ..... B08B 9/20
(52) U.S. Cl. ..... 134/25.2; 134/32
(58) Field of Search ..... 134/25.2, 32, 42, 134/57 D, 56 D, 58 D, 61, 63, 133, 137, 138

(56) References Cited

U.S. PATENT DOCUMENTS 4,233,083 * 11/1980 Roberts ..... 134/25.2
4,274,886 6/1981 Noren ..... 134/25.2
4,697,711 * 10/1987 Noren ..... 134/35.2 X

FOREIGN PATENT DOCUMENTS 1952163 5/1971 (DE) .
2 304 313 10/1976 (FR) .
1497235 * 1/1978 (GB) .
WO 96/01584 1/1996 (WO) .

* cited by examiner

*Primary Examiner*—Alexander Markoff
(74) *Attorney, Agent, or Firm*—Finnegan, Henderson, Farabow, Garrett & Dunner, L.L.P.

(57) ABSTRACT

Equipment arriving from an aircraft in transport carts is sorted in an air catering kitchen by transport carts with trays and tray equipment being sorted on one side of a conveyor belt whereas transport carts containing drawers and serving equipment are sorted at the opposite side of the conveyor belt, following which the equipment is taken to an industrial dishwasher. Trays and tray equipment are sorted by discharging the contents of the tray onto a conveyor belt following which the individual tray items are arranged in baskets. Transport carts containing drawers with serving equipment are sorted at the opposite side of the conveyor belt, the drawers being arranged on rollers mounted in the side walls of a box. Following washing of the equipment in the dishwasher, the serving equipment arrives at an area with cleaned transport carts where the equipment is again arranged in the transport carts following packaging in drawers.

10 Claims, 3 Drawing Sheets

Figure 1:
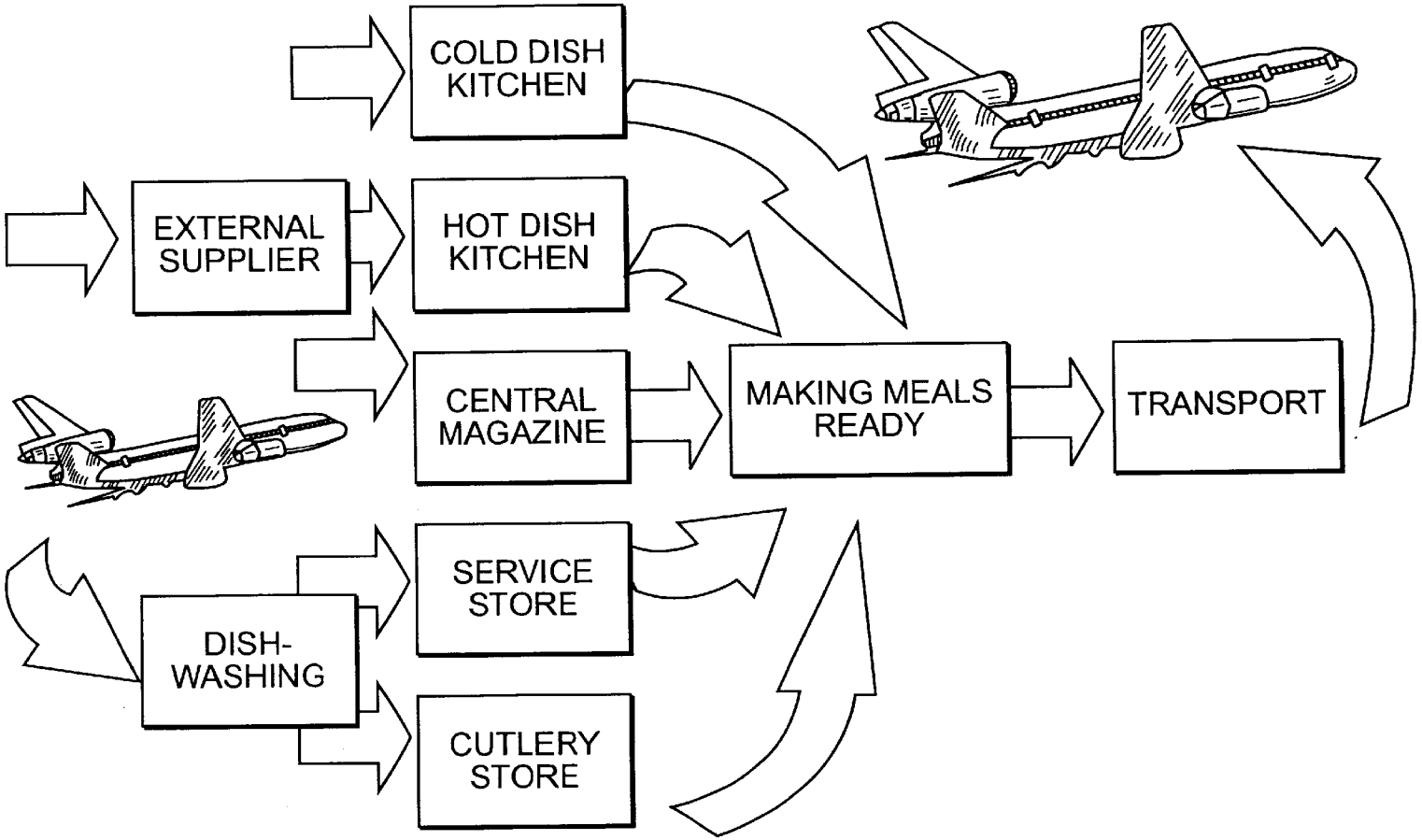
FIG. 1 PRIOR ART

METHOD OF WASHING DISHES AND PREPARING EQUIPMENT FOR USE IN THE ARRANGEMENT AND SERVING OF FLIGHT MEALS

The present invention relates to a method of washing and preparing equipment for use in the arrangement and serving of flight meals, wherein the equipment is transported to and from the aircraft in transport carts, and wherein the method comprises the following steps:

receiving the transport carts in an air catering kitchen, said carts containing the equipment that comprises soiled tableware arranged on trays and serving equipment arranged in drawers, removing the equipment from the transport carts sorting of trays, tableware, drawers and serving equipment transporting the trays, tableware, drawers and serving equipment on a conveyor belt to a dishwasher.

The huge air traffic that is handled throughout the world and the many suppliers of services in connection with said flight transports mean that there exists at all times and at all levels a need for promoting the efficiency.

This applies to the preparation of flight meals, too, the number of which is quite colossal in view of the very large number of flight departures handled every day throughout the world.

Since very large numbers of flight meals are prepared, it goes without saying that any promotion of efficiency in this context will obviously be quite crucial if the fierce competitive environment between suppliers is to be coped with.

Exactly in connection with the preparation of flight meals, it is important that the highest possible degree of efficiency is obtained, including savings in storage space for tableware and the like. This constitutes an item of considerable importance since the stores are to be found in the environment surrounding the airport where the price per square meter is high.

One quite efficient way of rationalising the preparation flight meals is known from published PCT application No. 96/01584.

The philosophy underlying this known method is first and foremost concerned with saving storage space for transport carts, tableware and serving equipment. This is achieved when an aircraft arrives with soiled tableware and delivers this soiled tableware to a kitchen where trays with soiled tableware are instantly made ready with equipment intended for a subsequent flight departure. Following preparation of the trays, they are taken through a dishwasher following which foodstuffs are arranged thereon.

This method has proved to be highly efficient and storage space saving and has enabled handling of up to about 250 trays per hour corresponding to an average of 2500 trays per day involving a staff of about 10 employees.

Although said method is efficient it has been found, however, that certain problems may arise when the composition of the trays and the equipment that arrive differ widely from the trays that are to be shipped to a subsequent flight departure. These problems may originate i.a. in the fact that in addition to making different requirements to the composition of tray equipment, different airlines even use different tray equipment. Thus, a bottleneck may easily occur during handling of the trays on the so-called "soiled" side since quite a number of operations may be involved at this point if the tray is to be prepared for a composition which is entirely different from the one just arrived.

In addition to actual tray equipment the flight further carries accessory serving equipment, such as pitchers, salt shakers, tablecloths, etc., which is packed in drawers arranged in transport carts.

This type of equipment is quite comprehensive in case of overseas flights where the passengers are to a somewhat higher degree individually served.

It is now an object of the invention to improve the existing system whereby handling of the arrangement of air meals and preparation of serving equipment may be made even more efficient to allow even more improved storage space economy.

The object of the invention is obtained by a method of washing and preparing equipment for use in the arrangement and serving of flight meals wherein said equipment is transported to and from the aircraft in transport carts which is characterized in that sorting is carried out at each side of a conveyor belt, tableware arranged on trays being sorted at one side of the conveyor belt, while serving equipment arranged in drawers is sorted at the other side of the conveyor belt.

This allows for extremely efficient organisation of the working procedures. The fact that the sorting takes place at both sides of the conveyor belt allows the procedure to be organised in correspondence with the changing needs of different types of flights. As mentioned, overseas flights require handling of a considerably larger amount of serving equipment since it is hereby possible to meet the individual needs of the passengers on board such aircrafts.

The individual tray items, including waste, are discharged on to an additional conveyor belt, said additional conveyor belt having a direction of movement which is opposite that of the conveyor belt, following which the individual tray items are sorted out into each their basket, and that the baskets are conveyed on to the conveyor belt following filling and into the dishwasher while all waste continues to the additional conveyor belt from which it drops into a waste basket, allows for very efficient sorting of trays, cups, plates, cutlery, etc.

According to the method it is also advantageous that the standard equipment arranged in drawers is passed on to a transport device comprising two rollers mounted on the inside of two oppositely arranged side walls in an elongated box with a bottom, following which the contents of the drawer are arranged in baskets that, following filling, are passed on to the conveyor belt that conveys the baskets on to the dishwasher.

In this manner serving equipment may also be sorted in a very efficient manner. In this context is should be noted that the individual items of the serving equipment which may include pitchers, dishes, spare glasses, etc., have dimensions that are typically somewhat larger than tray equipment which means that the tray equipment is advantageously served on conveyor belts whereas, as mentioned, the serving equipment is sorted directly from the drawers that are advanced on the rollers of the transport device.

Also in connection with serving equipment some waste will occur. This is readily disposed of by discharging the waste from the serving equipment into the box.

Conveniently, the baskets for trays as well as tableware and drawers and serving equipment are arranged on a rack that has a downwardly inclining bottom plate and an upwardly inclining frame and wherein the upwardly inclining frame has dimensions that correspond to the bottoms of the baskets.

This makes it easy to handle the baskets since the baskets may be pushed directly from the upwardly inclining frame onto the conveyor belt optionally by using an empty basket as pushing means.

By intending the inclining bottom plate oh the racks on each side of the conveyor belt for receiving waste that is not discharged into the box at the side of the conveyer where the drawers and serving equipment is sorted, a convenient manner is provided of removing this waste since, in all simplicity, it slides down the downwardly inclining bottom plate, optionally aided by the supply of water to this bottom plate.

Conveniently, waste is passed from the inclining bottom plate to a central area below the conveyor belt from where it is removed by means of flushing.

It is a further advantage that the empty transport carts are taken to an additional dishwasher for transport carts where they are cleaned, and subsequently to an area in which the conveyor belt conveys cleaned drawers and serving equipment.

Hereby the particular advantage is provided that the cleaned drawers and their contents are not to be taken to a store but are arranged directly, in the transport carts that thus serve as stores. In this context it should be noted that the transport carts that contain serving equipment never contain foodstuffs and it follows that they may be made ready and simply left at the conveyor belt where they await their departure on a flight.

Figure 2:
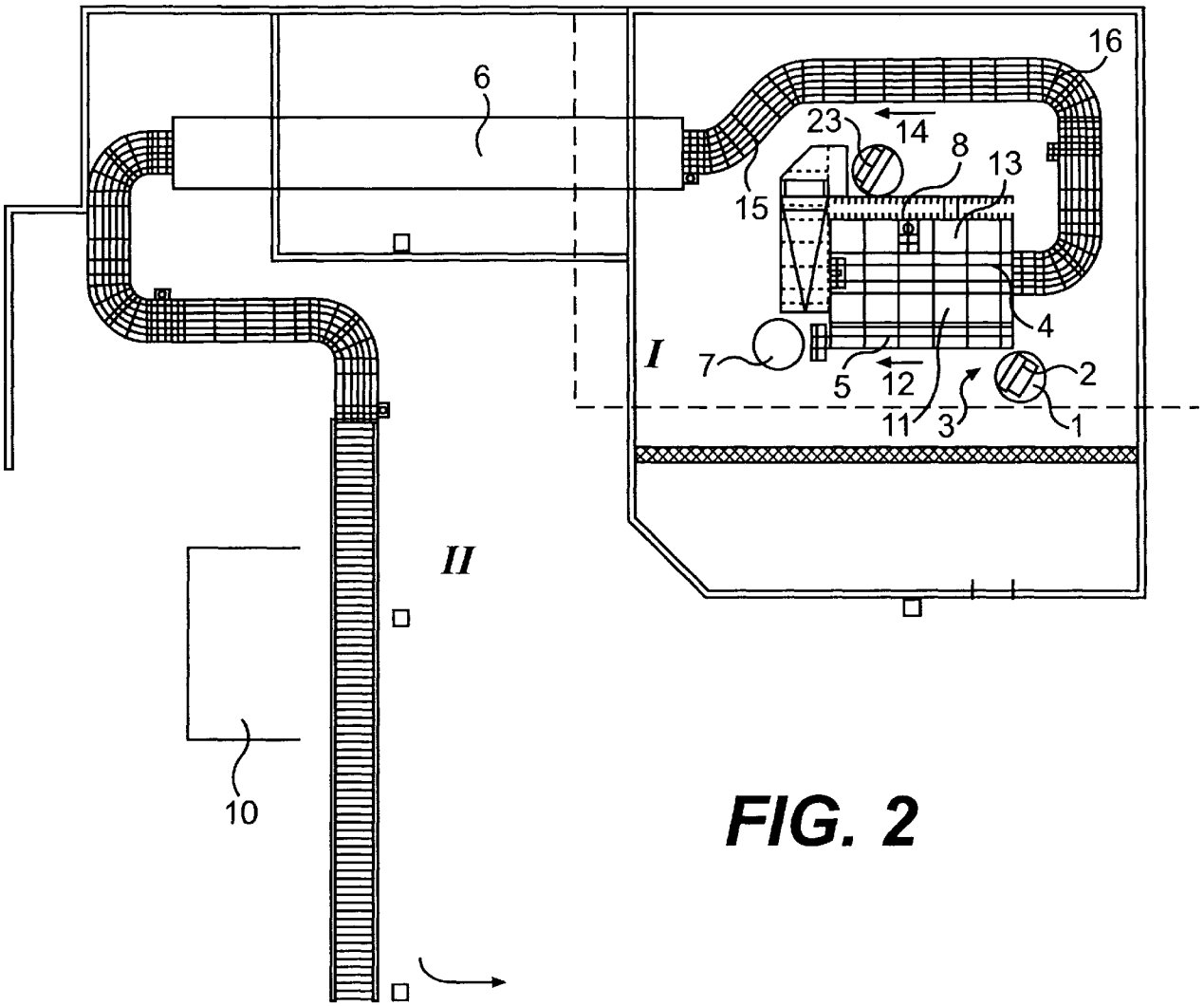
Figure 3:
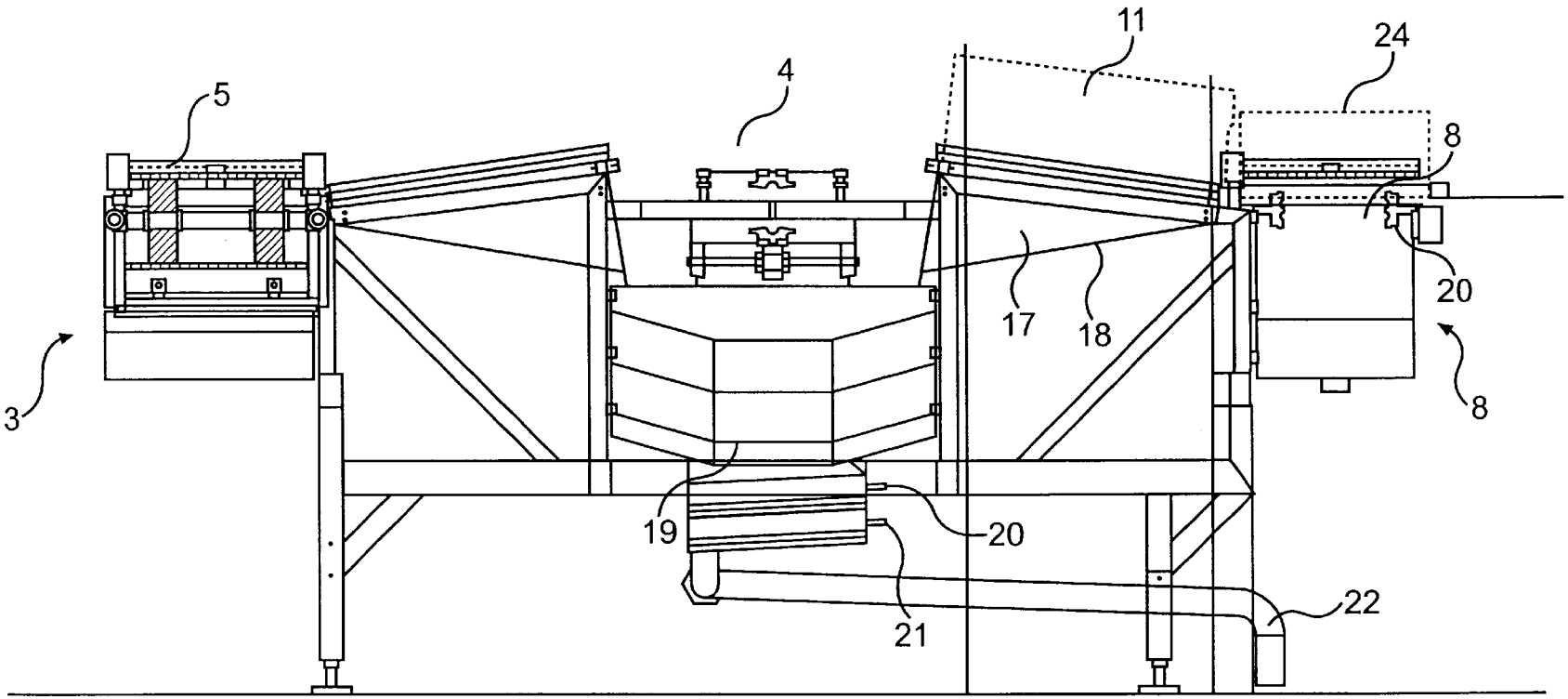

The invention will now be explained in further detail with reference to an embodiment shown in the drawings, wherein FIG. 1 illustrates typical steps in a method of preparing flight meals, FIG. 2 schematically illustrates how the principles of the invention are implemented in an air catering kitchen, and FIG. 3 schematically shows a cross section of the sorting area before the dishwasher.

To the left in FIG. 1 an air craft is shown which has arrived while an aircraft ready for departure is shown to the right in FIG. 1. As will appear from the Figure, a cold dish kitchen and a hot dish kitchen receive foodstuffs from an external supplier, said food being arranged on trays equipped with tableware. Prior to this, however, the soiled tableware from the plane arrived has been washed and typically this tableware will be arranged in stores for cutlery and ordinary tableware, respectively. When the flight meals are to be portioned, the tableware and trays are taken from the stores and food is portioned thereon following which they are sent in transport carts to a flight for the next departure. In addition to transport carts with trays and tableware, there will also usually be transport carts containing drawers with serving equipment, such as pitchers, trays, salt and pepper, tablecloths, etc. This applies in particular to overseas departures where the passengers are often individually served. Typically these transport carts are also packed at the storage facility.

This known way of organising in connection with the preparing of transport carts is associated with certain drawbacks. In particular a quite considerable amount of storage space is required and the tray turnover per hour is not optimal either.

As mentioned above, the conditions for promoting the efficiency have been considerably improved by means of the method known from the above-identified PCT application published under No. WO 96101584.

According to the invention this known method has become even more efficient as will appear from the more detailed explanation given with reference to FIG. 2.

In FIG. 2, I is used to designate an area in which the soiled tableware from an arrived aircraft is handled. II is used to designate an area for cleaned trays, tableware, drawers, and serving equipment.

As will appear, area I receives a number of transport carts 2 on a storage device 1 for transport carts. Herein that side of the sorting unit 3 is shown at which the transport carts with trays and tray equipment arrive. One or more persons now discharge the trays onto the conveyor belt 5 that moves in the direction of the arrow 12. The individual items on the trays, such as cups, plates, cutlery, etc., are sorted out and arranged in not shown baskets in areas designated by the reference numeral 11. The Figure features five such areas but nothing prevents the presence of more such areas in order to enable sorting of more types of equipment. Waste arrived along with the tray equipment is conveyed on the conveyor belt down to a waste container 7. When a basket in the area 11 is full, a subsequent basket is seized and used to push the full basket onto the conveyor belt 4 from where it is transported via the conveyor belt 16 to an industrial dishwasher 6 in the direction of the arrow 14. At the other side of the sorting area 3, transport carts 23 arrive that contain serving equipment arranged in drawers. This equipment is also sorted in baskets arranged in areas as indicated by the reference numeral 13 in a manner similar to that of the tray equipment at the opposite side. As will appear from FIG. 2, the sorting starts at the end opposite that of the sorting of the tray equipment, and a conveyor belt is not used in the sorting. On the contrary, the sorting is effected, cf. FIG. 3, by drawers indicated by dashed lines by the reference numeral 24 being arranged on a pair of rollers 20 mounted in a box 8 with two side walls.

Once the drawer is arranged on the rollers, the equipment is taken from the drawers and arranged in baskets illustrated schematically by the reference numeral 11. Any waste from the serving equipment is dropped to the bottom of the box 8. FIG. 3 further illustrates that the basket 11 is arranged on a rack with a downwardly inclining surface 18 and an upwardly inclining rack 17. Any remaining waste from the basket 11 may now pass through the rack 17 and down onto the downwardly inclining bottom plate 18 and from there optionally by means of water supply it is conveyed into a central area 19 below the conveyor belt 4 From here the waste is passed on towards a grid system 20,21 from where water is conveyed out through a pipe 22. As will appear there are two grids 20,21 which means that it is possible to clean the one grid while the other remains in position which eliminates the need for operation shut downs of the sorting area. To the left in FIG. 5 the conveyor belt 5 for sorting equipped trays is shown.

Besides, the rack is removably arranged so as to facilitate access for cleaning purposes.

In the following it will be briefly described how transport carts coming from an aircraft is handled in a process.

From a truck the transport carts are taken onto a ramp where an initial sorting is carried out during which equipment outside the transport carts is removed on the ramp. The transport carts are subsequently driven into the air catering kitchen, transportation carts with trays and tray equipment being sorted on the conveyor belt 5 while the transport cart with drawers containing serving equipment being sorted at the opposite side. During sorting the equipment is arranged in baskets which are, upon filling, conveyed to the industrial dishwasher 6 via the conveyer.

Following dishwashing in the industrial dishwasher 6 the equipment is passed on to an area 10 where serving equipment and drawers are packed in transport carts that have been cleaned in a particular dishwasher for transport carts. Trays and serving equipment are passed on to a not shown area where they are prepared for use.

As will appear, the method thus improved presents an extraordinarily essential flexibility since the sorting is carried out in such a manner that the manning may be adapted exactly to the relevant place in need of staff. Moreover very large savings in terms of storage space are obtained since the transport carts are in themselves used as storage space for serving equipment.

What is claimed is:

1. In a method of preparing equipment for use in arranging and serving flight meals wherein the equipment is transported to and from an aircraft in transport carts, and wherein the transport carts are received in an air catering kitchen, certain of the carts containing soiled tableware arranged on trays and others of the carts containing serving equipment arranged in drawers, the equipment is removed from the transport carts, trays, tableware, drawers and serving equipment are sorted, and the trays, tableware, drawers and serving equipment are transported on a conveyor belt to a dishwasher, the improvement comprising:

sorting the soiled tableware arranged on trays at one side of the conveyor belt, and sorting serving equipment arranged in drawers at the other side of the conveyor belt.

2. The method of claim 1, wherein the sorting of soiled tableware comprises discharging individual items of soiled tableware on the trays, including waste, onto an additional conveyor belt having a direction of movement opposite the direction of movement of the conveyor belt, and then sorting the individual items from the additional conveyor belt into respective baskets, transferring filled baskets to the conveyor belt and on to the dishwasher, and conveying the waste on the additional conveyer belt to a waste container.

3. The method according to claim 1, wherein the sorting of service equipment comprises conveying the serving equipment in drawers onto a transport device comprising two rows of rollers mounted on the inside of mutually opposite side walls in an elongated box having a bottom, then transferring the contents of the drawers into baskets, and transferring the baskets filled with the contents of the drawers to the conveyor belt to convey the baskets on to the dishwasher.

4. The method of claim 3, including discharging waste from the serving equipment into the elongated box.

5. The method of claim 1, wherein the sorting of soiled tableware comprises discharging individual items of soiled tableware on the trays, including waste, onto an additional conveyor belt having a direction of movement opposite the direction of movement of the conveyor belt, and then sorting the individual items from the additional conveyor belt into respective baskets, transferring baskets filled with the individual items of soiled tableware to the conveyor belt and on to the dishwasher, and conveying the waste on the additional conveyer belt to a waste container, and wherein the sorting of service equipment comprises conveying the serving equipment in drawers onto a transport device comprising two rows of roller mounted on the inside of mutually opposite side walls in an elongated box having a bottom, discharging waste from the serving equipment into the elongated box, then transferring the contents of the drawers into baskets, and transferring the baskets filled with the contents of the drawers to the conveyor belt to convey the baskets on to the dishwasher.

6. The method of claim 5, including placing the baskets filled with individual items of soiled tableware, and drawers for serving equipment on rack devices on opposite sides, respectively, of the conveyor belt, each of the rack devices having a downwardly inclining bottom plane and an upwardly inclining rack, and wherein the upwardly inclining rack has dimensions corresponding to the bottoms of the baskets.

7. The method of claim 6, wherein the inclining bottom plane of the rack device on each side of the conveyor belt receives waste that does not drop into the waste container at the side of the conveyor belt for trays and tableware, and that does not drop into the elongated box at the side of the conveyor belt where drawers and serving equipment are sorted.

8. The method of claim 7, including conveying waste from the inclining bottom planes of the rack devices to a central area below the conveyor belt, and flushing the waste from the bottom planes.

9. The method of any one of claims 1–4, including conveying empty transport carts to a further dishwasher for transport carts where they are cleaned, and then transferred to an area of the conveyor belt transporting cleaned drawers and serving equipment.

10. The method of any one of claims 1–4, including packing cleaned serving equipment into cleaned drawers and then placing the cleaned drawers into the transport carts.

* * * * *